United States Patent [19]

White

[11] Patent Number: 5,017,101

[45] Date of Patent: May 21, 1991

[54] SELECTIVELY OPERATED GEROTOR DEVICE

[76] Inventor: Jeffrey White, 243 Pyle La., Hopkinsville, Ky. 42240

[21] Appl. No.: 463,012

[22] Filed: Jan. 9, 1990

Related U.S. Application Data

[63] Continuation of Ser. No. 174,966, Mar. 29, 1988, abandoned.

[51] Int. Cl.[5] ..... F04B 49/08

[52] U.S. Cl. ..... 417/310; 417/440

[58] Field of Search ..... 417/283, 310, 440; 418/61.3

[56] References Cited

U.S. PATENT DOCUMENTS

| | | | |
|---|---|---|---|
| 3,713,757 | 1/1973 | Hause | 417/283 X |
| 3,778,198 | 12/1973 | Giverson | 418/61.3 |
| 4,082,480 | 4/1978 | McDermott | 417/310 X |
| 4,184,813 | 1/1980 | Rylewski | 417/440 |
| 4,435,130 | 3/1984 | Ohrberg et al. | 417/310 |
| 4,639,203 | 1/1987 | Zumbusch | 418/61.3 |
| 4,872,819 | 10/1989 | White, Jr. | 418/61.3 |
| 4,877,383 | 10/1989 | White, Jr. | 418/61.3 |

*Primary Examiner*—Leonard E. Smith
*Assistant Examiner*—Eugene L. Szczecina, Jr.
*Attorney, Agent, or Firm*—Woodling, Krost & Rust

[57] ABSTRACT

A gerotor structures is disclosed having a fluid bypass means for selectively siphoning off the high pressure fluid from the expanding gerotor cells so as to disable the operation of the device.

25 Claims, 6 Drawing Sheets

SELECTIVELY OPERATED GEROTOR DEVICE

This is a continuation of application Ser. No. 174,966 filed on Mar. 29, 1988, now abandoned.

FIELD OF THE INVENTION

This invention relates to an improved selectively operable gerotor device.

BACKGROUND OF THE INVENTION

Gerotor hydraulic devices are becoming more and more commonplace. In addition to the archtypical agricultural operations such devices are now also found in industrial applications such as robots and mechanized transportation equipment. With these increasing numbers of applications comes an ever increasing need for application specific designs, designs including disengageable drives. As gerotor devices are high torque devices, disengageable drives mean expensive clutches and/or restrictions for engagement. Present attempts to remedy these characteristics, such as multi-pack clutches, external recirculating valves or one-way drive mechanisms, are not efficient in either cost or practicality. The present invention is directed towards providing a more practical, cost-effective selectively operated gerotor device.

SUMMARY OF THE INVENTION

The present invention is directed towards providing a gerotor device having a selective operation.

It is an object of this invention to selectively engage or disengage a high torque gerotor device.

It is an object of this invention to lower the cost of disengageable gerotor devices.

It is an object of this invention to increase the longevity of disengageable gerotor devices.

Other objects and a more complete understanding of the invention may be had by referring to the following specification and drawings in which:

DESCRIPTION OF THE PREFERRED EMBODIMENT

Figure 1:
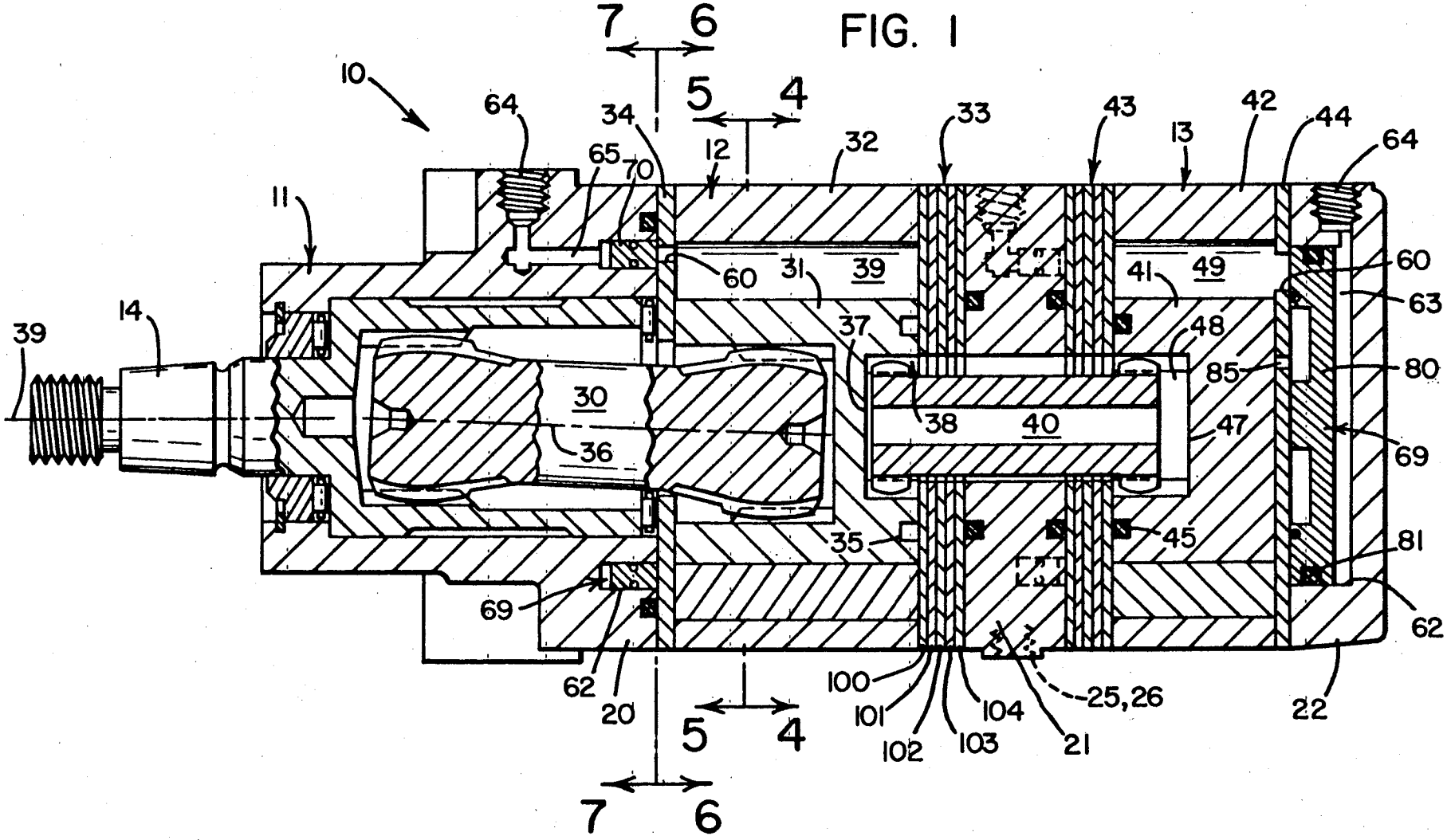
FIG. 1 is a central longitudinal cross-sectional view of a gerotor motor incorporating the invention of the application.

The invention of this present application relates to a disengageable drive gerotor device 10 for use in pressure differential operated devices. The preferred device includes a housing 11, two gerotor structures 12, 13 and a drive shaft 14.

The housing 11 is a steel structure some 12" in length. The housing 11 includes a front mounting and bearing member 20, an intermediate porting member 21 and an end plate 22. The front member 20 is designed to mount the device 10 onto any associated mechanism and to retain the drive shaft 14 in place against loads including radial side loads. The intermediate porting member 21 is designed to provide a single, heavy unitary plate for the fixed connection of tubing to the input and discharge ports 25, 26 for the device 10. The end plate 22 is designed to terminate the device 10.

The gerotor structures are located intermediate to the ports 20, 21 and 22 of the housing 11. Each gerotor structure 12, 13 includes a wobblestick 30, 40; a rotor 31, 41; a stator 32, 42; a manifold plate 33, 43; and a disengaging plate 34, 44.

The wobblesticks 30, 40 are each sized for their application.

The lead wobblestick 30 is the main angular drive connection between the combined rotors 31, 41 and the drive shaft 14. This lead wobblestick 30 is therefor long (to reduce the angle between the longitudinal axis 36 of the wobblestick 30 and the longitudinal axis 39 of the drive shaft 14) and of a sizeable diameter (to handle the combined torque of both rotors 31, 41).

The secondary wobblestick 40 is the associate drive connection between the rotors 31, 41. This secondary wobblestick 40 is located axially in line with the axial centers of both rotors 31, 41. The wobblestick 40 is located in its operating position by the closed walls 37, 47 of the rotors 31, 41. In the operation of the device the axial centers of the rotors 31, 41 and the axis of the secondary wobblestick 40 all together trace a phantom cylinder about the central axis of the device (an extension of the longitudinal axis 39 of the drive shaft 14 in line with the axial centers of the stators 32, 42 of the gerotor structures 12, 13). The wobblestick 40 is therefor short and tightly fitted into the rotors 31, 41. The wobblestick 40 is sized to transfer the torque of but the single rotor 41. Note that in the preferred embodiment shown the gerotor structures 12, 13 are sized and angularly oriented such that the axial centers of the rotors 31, 41 trace equally sized circles about the axis of their respective stators 32, 42 and in addition there is a rotational congruence of the rotors 31, 41 in respect to the drive shaft 14 (i.e. the wobblestick 40 is and remains in line with the rotors 31, 41). For this reason one technically could make the preferred rotors 31, 41 and wobblestick 40 out of a single piece of machined steel. The relationship between the parts is stable. (Rotating the gerotor structures 12, 13 allows one to offset the location of the top dead center gerotor cell between the two structures while retaining an alignment between the axis of the two rotors). In other embodiments of the invention the rotors could trace differing sized circles, and/or could have diverging rotational congruence to meet the actual or desired requirements of the particular application, in which case the wobblestick 40 may have to provide an angular compensation between rotors 31, 41.

The gerotor structures 12, 13 shown have differing displacements. This is due to the fact that the rotors 31, 41 are differentially sized with similar diameters but with differing lengths. This reduces harmonics and other problems that would be associated with similar sized gerotor structures. In other embodiments of the invention the displacements of the gerotor structures 12, 13 could be similar or, if varied, varied by another method.

The manifold plates 33, 43 are designed to match the orientation of their respective rotor-stator 31-32, 41-42 combinations.

The manifold plates 33, 43 are the main commutation/valving fluid connections for the device 10. These manifold plates are built of multi-plate construction. The multi-plates 100-104 are designed each with a different cross-section of the commutation and valving passages for the device (FIGS. 9-13). The fluid from port 25 travels through holes 105 in plates 104, 103, 102 and the commutation passages 106 in plate 101 to the seven outer annular holes 107 in plate 100.

From the outer holes 107 in the plate 100 the fluid communicates through the outer annular channels in the rotor to some of the openings 110 that are located inside the outer holes 107. The openings 110 extend through plates 100, 101 and 102 to connect with the spiral passages 111 in plate 103 and through the spiral passages 111, 112 to connect with openings 112, respectively. Openings 112 extend through plates 102, 101 and 100 to open into the gerotor cells of the device 10.

While the outer holes 107 are communicating by openings 111 to openings 112 leading to expanding gerotor working chambers cells, working chambers or geroter from other openings 112 leading from contracting fluid cells communicates through other spiral passages 111 and other openings 110 to the center of the rotor and via the hole 115 to the other port 26 with the center passage of the device through the drive hole 141 in the center of the rotor. (For a more complete explanation of this valving see Mr. Hollis White's U.S. Pat. No. 4,474,544, issued Oct. 2, 1984.)

In an opposite rotation the reverse would be true.

In this hydraulic device plates 100-104 are brazed together to form a single unitary structure.

Somewhere between the source of fluid (i.e. the pump) and the gerotor cells there is a restriction—i.e. some particular fluid passage, opening or combination thereof that can pass less fluid than the others for a given pressure of fluid. This restriction places a certain limit on the volume of fluid that can enter the gerotor cells at any given point of time. The restriction normally is within the gerotor device. In the device shown this is such a case with the limit occurring due to the size of the passages 111. In other devices the limit could, however, be elsewhere. This certain limit is important to the preferred form of the invention of this application as will be later described.

All openings in the manifold plates are oriented to match the respective gerotor structure 12, 13. The rotors 31, 41 single plane commutate and valve their respective gerotor structure 12, 13. This is preferred from the alternative of using one rotor to valve both gerotor structures (as could occur by connecting the gerotor cell openings of one manifold plate 33, 43 to the appropriate gerotor cells of both gerotor structures 12, 13 and eliminating the other manifold plate 33, 43).

The fluid ports 25, 26 for both manifold plates 33, 43 are located on a porting member 21 between the two manifold plates 33, 43. One fluid port connects directly to the centers 38, 48 of both rotors 31, 41. The other fluid port connects to the other valving groove 35, 45 of both rotors 31, 41 through the manifold plates 33, 43. Alternately, if independent gerotor structure operation is desired, each gerotor structure 12, 13 could have its own independent ports. This could be accomplished for example by switching the manifold plate 33 with the balancing plate 34 for the structure 12 and providing the additional ports in the housing 11 for the manifold plate 33.

The disengagement plates 34, 44 are designed to effectively disable the high pressure feed of the single sided commutation and valving on the rotors 31, 41 respectively.

Each disengagement plate 34, 44 is a steel plate fixedly connected at its outer edges to the housing 11 or its end plate 22. The gerotor mechanism 12, 13 is located on one side of the plate 34, 44 and a disengagement cavity 62 on the other. A moveable piston (later described) divides the cavity 62 into two sides 61, 63. A series of holes 60 extend through the disengagement plate 33, 44 to connect the expanding/contracting gerotor cells 39, 49 with one side 61 of the disengagement cavity 62. The other side 63 of the disengagement cavity 62 is connected to a source of operating pressure—in the preferred embodiment an external port 64 in the housing 11 via internal passages 65. The moveable piston 69 is located within the disengagement cavity 62 dividing it in two —one side or chamber 61 (the fluid bypass) connected to the holes 60 and the other 63 (operating pressure) connected to the external port 64.

The moveable piston 69 moves within the disengagement cavity 62 depending on which chamber 61 or 63 has the higher pressure to act as a internal valve member for the device.

Figure 3:
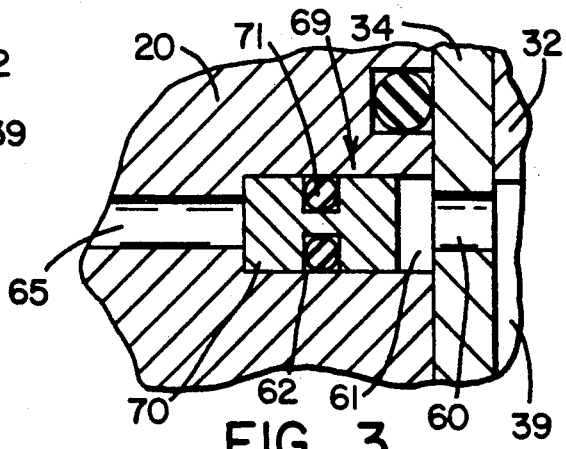
FIG. 3 is an enlarged cross-sectional view of the disengaging mechanism like FIG. 2 but in a position.
Figure 4:
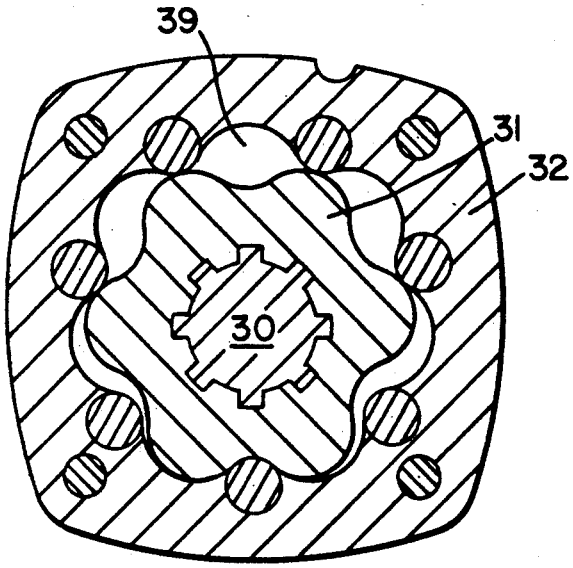
FIG. 4 is a widthwise cross-sectional view of the gerotor motor of FIG. 1 taken generally along lines 4—4 of that figure.
Figure 5:
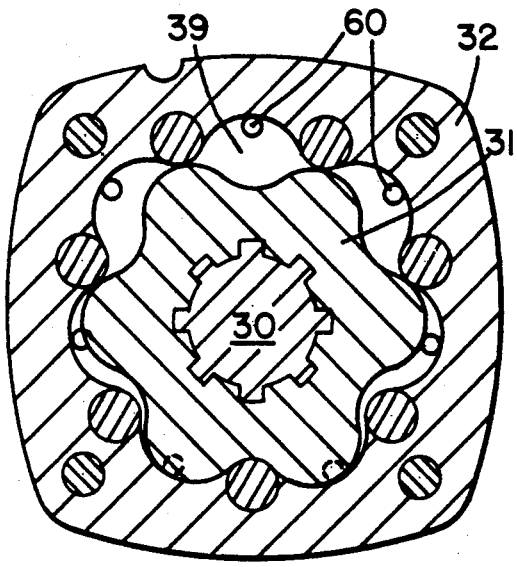
FIG. 5 is a widthwise cross-sectional view of the gerotor motor of FIG. 1 taken generally along lines 5—5 of that figure.
Figure 6:
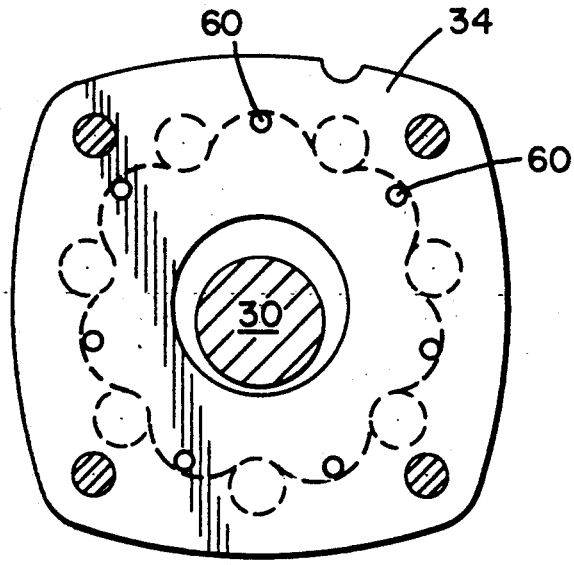
FIG. 6 is a widthwise cross-sectional view of the gerotor motor of FIG. 1 taken generally along lines 6—6 of that figure.
Figure 7:
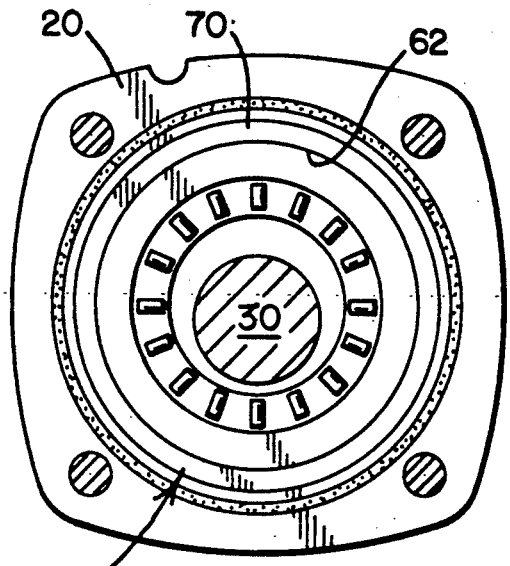
FIG. 7 is a widthwise cross-sectional view of the gerotor motor of FIG. 1 taken generally along lines 7—7 of that figure.

If the chamber 61 has the higher pressure, the piston 69 moves away from the holes 60 (FIG. 3). This allows fluid to flow from one gerotor cell 39, 49 through the holes 60 the ring shaped cavity 62 and other holes 60 to the other gerotor cells 39, 49—effectively reducing the displacement of that particular gerotor structure 12, 13. (To nothing in the preferred embodiment shown in FIG. 1.) This reduces the power of that gerotor structure—and thus effectively disengaging the drive to the shaft 14 from that gerotor structure 12, 13.

Figure 2:
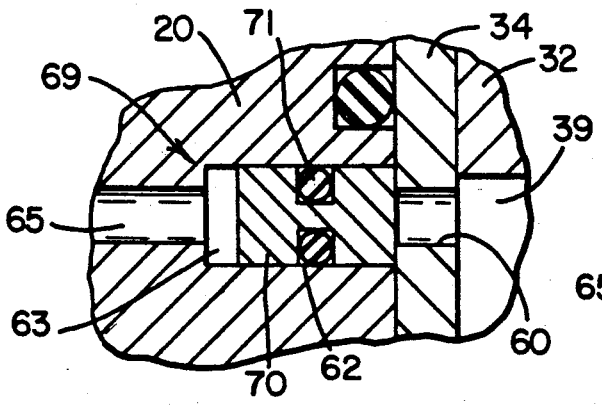
FIG. 2 is an enlarged cross-sectional view of the disengaging mechanism of the device of FIG. 1 in engaged position.

If the chamber 63 has the higher pressure, the piston 69 moves toward the holes 60 (FIGS. 1 and 2). This seals the holes 60—allowing the displacement of that particular gerotor structure 12, 13 to remain unaltered. This allows continued power from that gerotor structure—and thus engages the drive to the shaft 14 from that gerotor structure 12, 13.

In the preferred embodiment shown the differential is created by utilizing a higher pressure in chamber 63 than available in chamber 61. By toggling the chamber 63 between a pressure higher than in chamber 61 and a pressure less than in chamber 61 (0 preferred) the disengagement mechanism can be selectively operated. The speed of operation depends on the pressure differential between chambers as well as on the flow rate to and from the chambers (controllable by the sizes of the holes and passages through which the fluid of the chambers must pass)—a lower pressure differential and/or restrictive sizing producing slower operation.

In the embodiment shown which chamber 61 or 63 has the higher pressure is directly controlled through the selective connection of the external port 64 to a source of high pressure for the device. When the port 64 is connected to a source of higher pressure, the piston 69 moves to seal the holes 60—the pertinent gerotor device operates normally. When the port 64 is disconnected from this source of higher pressure, the piston 69 moves away from the holes 60 connecting such holes 60 to the chamber 61. Although port 64 is shown to manipulate the pressure differential, other means are also possible. For example if one altered the relative surface areas of the piston 69 such that there was more surface area in chamber 63 than in chamber 61 one could operate the disengagement mechanism with fluid having equal pressure on both sides of the piston 69. This has value by allowing a single pressure for all fluid. In addition one could thereby produce an automatically engaging device by connecting chamber 63 to the incoming pressurized fluid for the gerotor device 10: i.e. by valving the device 10 one also engages the drive with a single source of one degree of pressurized fluid. Other modifications are also possible without departing from the invention as claimed.

As previously mentioned, the fluid path leading to the gerotor cells is restricted—i.e. there will always be a certain limit on the volume of fluid that can enter the gerotor cells at any given point of time. In order for the disengagement mechanism to be totally effective in disengaging the drive, the smallest of holes 60 and chamber 61 should be sized to allow at least this volume of fluid to bypass between chambers—i.e. cause the effective pressure differential between the gerotor cells that are disengaged to be zero. Consideration should be taken that the volume of fluid that is already in the gerotor cells does not compromise this action—that this fluid also can move between cells so that hydraulic drag and/or lock-up does not occur. (Note that the fluid could be dumped from the device—i.e. draining off pressure rather than equalization. This could occur by connecting the chamber 61 to a low pressure line within (or without) the device 10.)

The size of the holes 60 could be sized differently to produce varying degrees of effectiveness. This action is later described. In the embodiment shown the holes 60 and chamber 61 both have an area greater than the area of passage 111 of the multi-plate section previously mentioned as being the restriction and in addition allow the fluid already in the gerotor cells to pass between the cells. This insures that both the holes 60 and chamber 61 can pass all of the fluid necessary to totally disable the device by producing a zero relative pressure between the gerotor cells. The disengagement mechanism, by providing a path of lesser resistance for the fluid of the gerotor cells, disengages the device 10: the fluid within the device recirculates instead of providing power. The engagement/disengagement of the drive of the gerotor device is thus easily controlled by the selective application of high pressure to these ports 64. (In the embodiment of FIG. 1 the two gerotor structures 12, 13 are independent of each other, i.e. two distinct ports 64. The two disengagement mechanisms could thus be operated individually or collectively as desired. In other types of devices independent or collective action might be appropriate.)

The moveable piston 69 could itself be any sort of mechanism that can be selectively operated to seal or drain the fluid from the holes 60 leading to the gerotor cells 39. This piston 69 could be a ring shaped "I" beam 70 containing o'ring seals 71 (left hand of FIG. 1, FIGS. 2 and 3), a unitary flat disk 80 having circumferential seals 81 (right hand of FIG. 1) or otherwise as desired. (Note that if a flat disk 80 piston is utilized an equalization hole 85 leading to an area of relative lower pressure is preferred to insure that any fluid otherwise trapped between the piston 80 and the plate 44 does not unduly impede the operation of the device). By altering the relative sizes of the surface areas of the piston 69 between the chambers 62 and 63 one can vary the pressure differential and operating characteristics as desired. For example a device that will operate even though the actual fluid pressure may be lower in chamber 63 than in chamber 61. In general the higher the force in chamber 63 the quicker the device will operate. Similarly with a greater flow rate into chamber 63. The specific piston 69, operating pressure, inlet size, etc. could therefore be varied to produce many differing effects.

The holes 60 and chamber 61 have been described to preferably have a larger flow capacity than the restriction leading to the gerotor cells 39 such that upon actuation of the disengagement mechanism the pertinent gerotor structure is totally disabled—thus disengaging the output of the gerotor structure. It should be noted, however, that by altering the relative capacity of the holes 60 and/or chamber 61 one can provide for power output of the gerotor structure associated with the mechanism intermediate to the full power or no power otherwise obtainable. Three examples of these varied power output mechanisms are shown in FIGS. 14–20.

In the first device of FIGS. 14–17 the hole 60 is split into many smaller holes 160 that in aggregate have the flow capacity to totally disable the associated gerotor structure (i.e. as described in reference to the single hole 60 of the preferred embodiment of FIG. 1). The effective displacement of the associated gerotor structure is related to the number of smaller holes 160 that are selectively connected to the bypass connection 161. For example in the FIGS. 14–17 there are five holes 161 for each gerotor cell, each hole 161 having 20% of the capacity of the total aggregate of holes 161. A seal member 200 in the end plate 122 can be selectively rotated (by rotating the gear 201) to variably connect none, one, two, three, four or all five of these holes to the bypass connection with the power of the gerotor structure 213 dependent on the number of holes 160 so connected. With five holes 160 connected (FIG. 16) the gerotor structure 213 is disabled. With three holes 160 connected (FIG. 17) the gerotor structure still utilizes substantially 40% of the fluid fed into the gerotor structure 213 and thus still produces a portion of its available power. With no holes 160 connected the gerotor structure 213 would produce substantially full power. The power of the gerotor structure 213 can be varied in the design of such units as desired through the choice of number, size and location of the smaller holes 160. This can be full range linear with discrete equal sized steps (for example as shown with five similar sized equally spaced holes 160) or otherwise as desired (i.e. portion of range and/or non-linear and/or non-discrete and/or non-equal sized steps) merely by varying the size, and/or location of the holes 160. (Note that other types of openings could be used instead of the holes 160 for example a continuous hole instead of discrete multiple openings. Indeed even the hole 60 of FIG. 1 could be variably open by a cam.) Note also that the means controlling the size of the opening 60 could be different from the means connecting such opening 60 to the bypass cavity 61—i.e. one part to adjust the size, one part to connect such separately sized opening to the bypass cavity 61.

Figure 18:
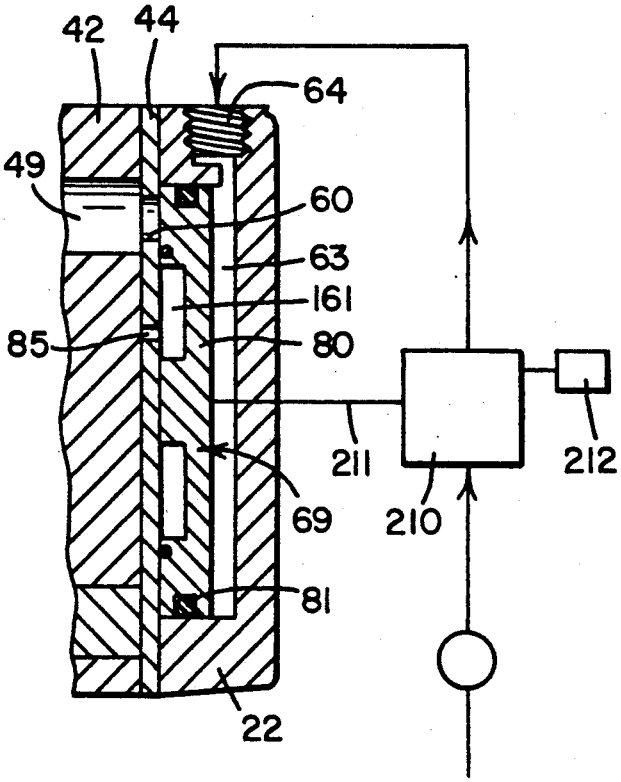
FIGS. 18–20 are selected views of a second modified adjustable displacement disengagement mechanism for gerotor devices.
Figure 19:
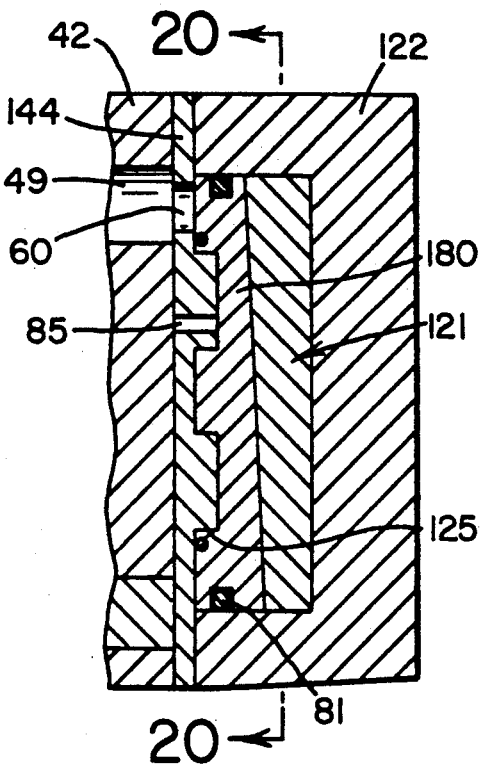
Figure 20:
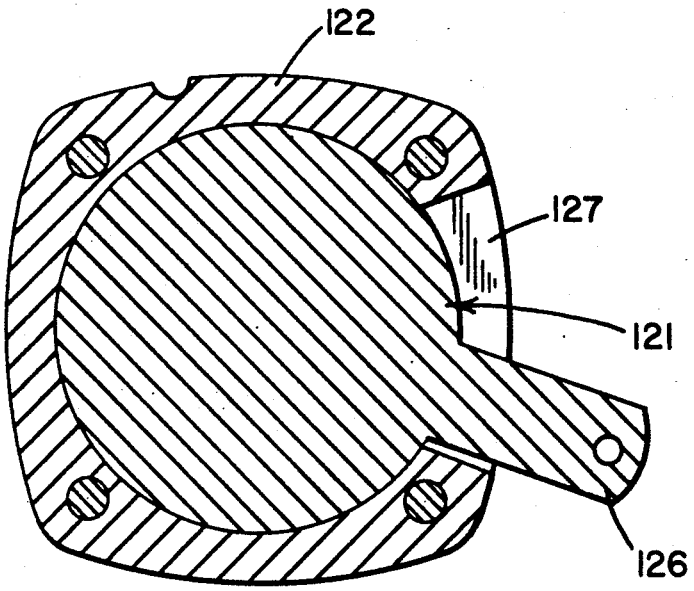

In the devices of FIGS. 18–20 the size of the chamber 61 is varied to alter the displacement of the device (instead of the holes 60 as shown in FIGS. 14–17). In these devices the effective flow capacity of the chamber 161 is selectively variable from the capacity to totally disable the associated gerotor structure to nothing. The effective displacement of the gerotor structure is dependent on the size of the chamber 161. For example a device having a chamber 161 with a flow capacity of 50% of the fluid entering the gerotor cells would produce substantially 50% power. Varying the capacity of the chamber 161 thus alters the power of the gerotor structure with which it is associated. The devices of FIGS. 18–20 are devices that can selectively alter the capacity of the chamber 161 from 0 to 100% capacity of the chamber 61. The device of FIG. 18 utilizes a feedback mechanism 210 connected 211 to the piston 80 to retain the piston 80 in a position set by an auxiliary control 212 (by varying the volume and/or pressure of the fluid in the chamber 63). By varying the position of the piston 80 in respect to the disengagement plate 44 one can alter the flow capacity of the chamber 161 by changing its effective cross-sectional area, i.e. the control 212 can be adjusted to set the piston 80 in such a position that the chamber 161 would have a set certain capacity (again from 0 to 100% of the chamber 61). The feedback connection 211 insures that the piston 80 remains in the set position. The device of FIGS. 19 and 20 utilizes a rotary cam 121 in combination with modified piston 180 mechanically alter the effective cross-sectional area of the chamber 161 by movement of the piston 180 to and away from the disengagement plate 144. In this device the piston 180 is prevented from rotating by a slotted connection 125 to the plate 144. The cam 121 occupies the space between the piston 180 and the end cap 122 with a handle 126 extending out of a slot 127 thereof. Upon rotation of the cam 121 by the handle 126 the piston 180 moves towards or away from the disengagement plate 141, thus varying the cross-sectional area of the chamber 161. Again the degree and linearity of adjustment would be selected to match the application. In the embodiment shown the 60 degree rotation of the cam 121 varies the capacity of the chamber 161 from 0 to 100% of the chamber 61 (i.e. engaged on disengaged gerotor structure). Other types of mechanical cams could also be used to vary the size of the chamber 161.

Figure 8:
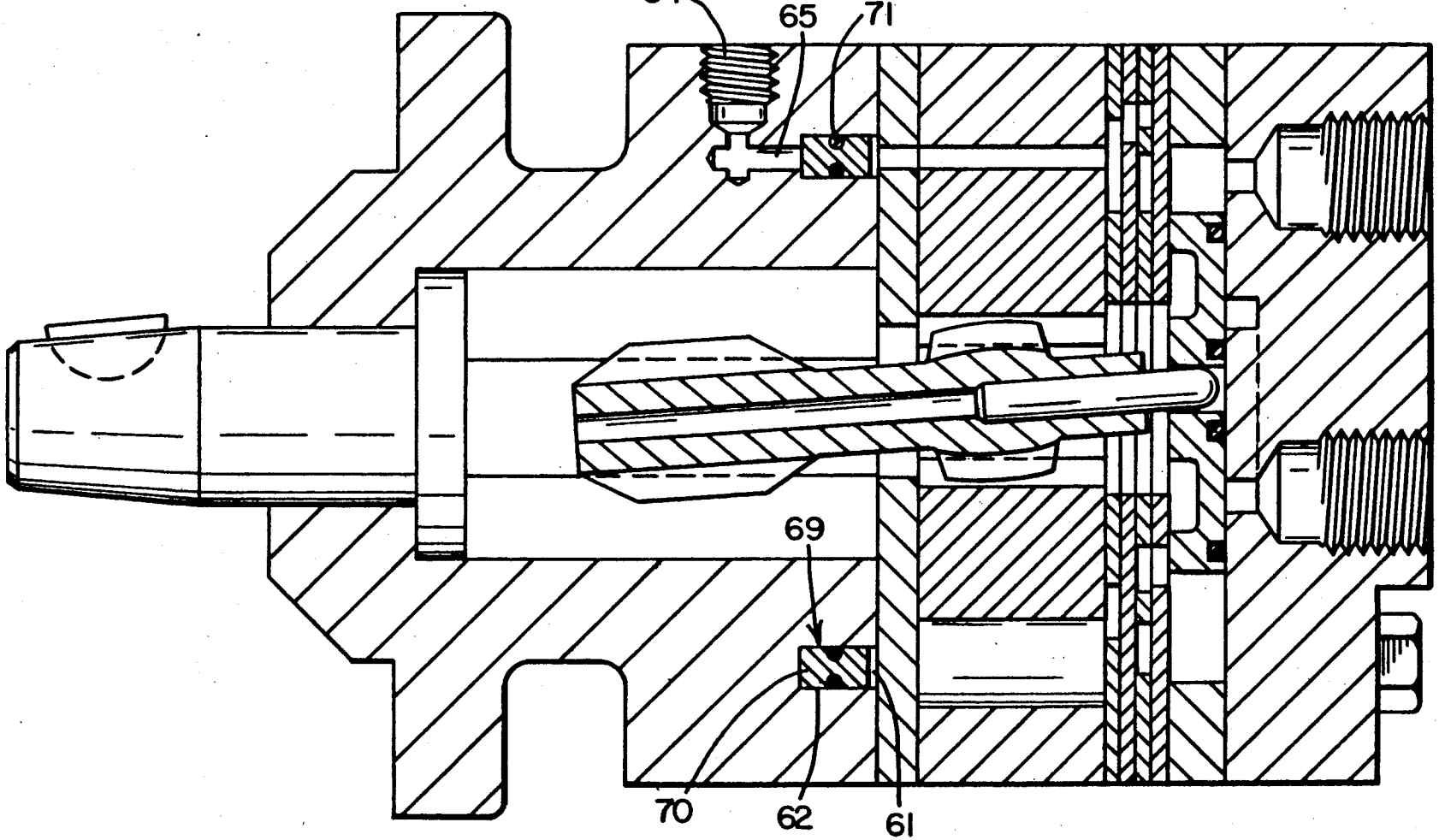
FIG. 8 is a central longitudinal cross-sectional view of a separate orbiting valve gerotor motor incorporating the invention of the application.
Figure 9:
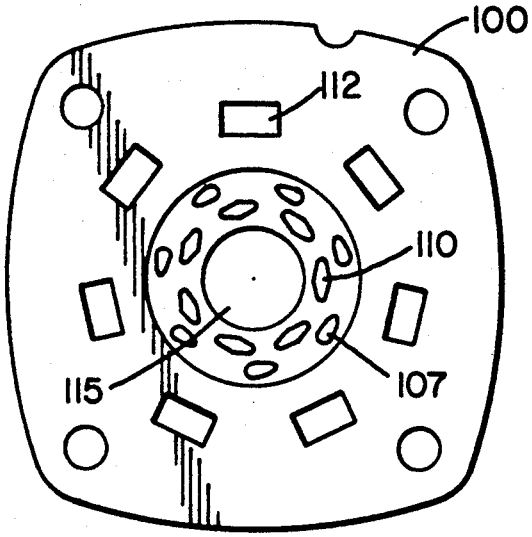
FIGS. 9–13 are selected cross-sectional views of the manifold plates of the gerotor motor of FIG. 1.
Figure 10:
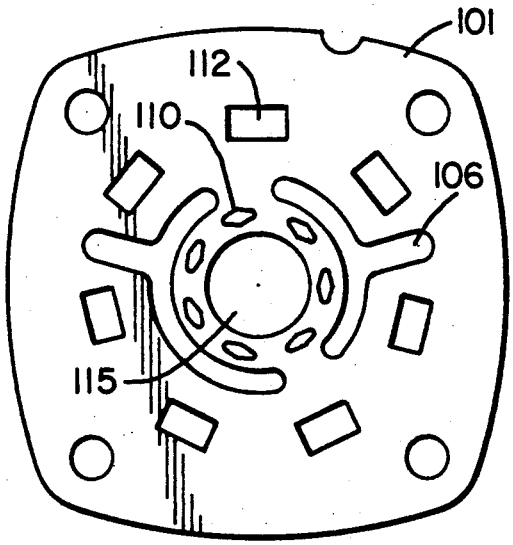
Figure 11:
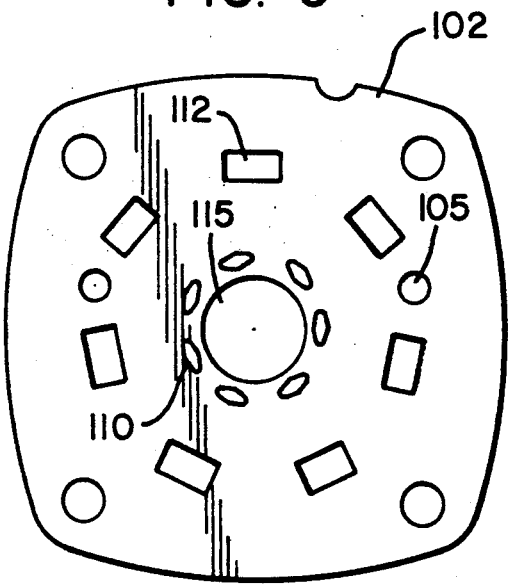
Figure 12:
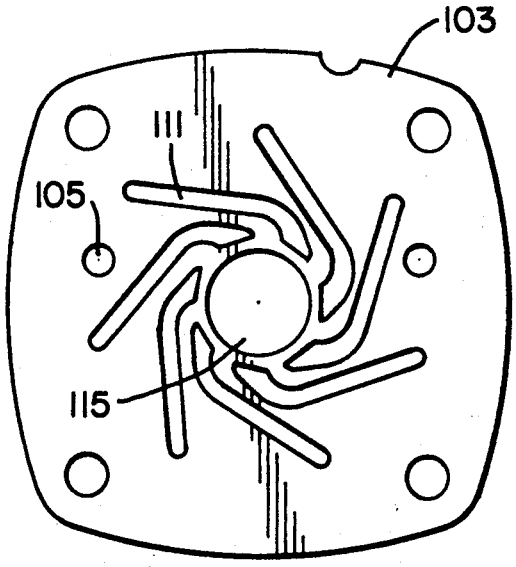
Figure 13:
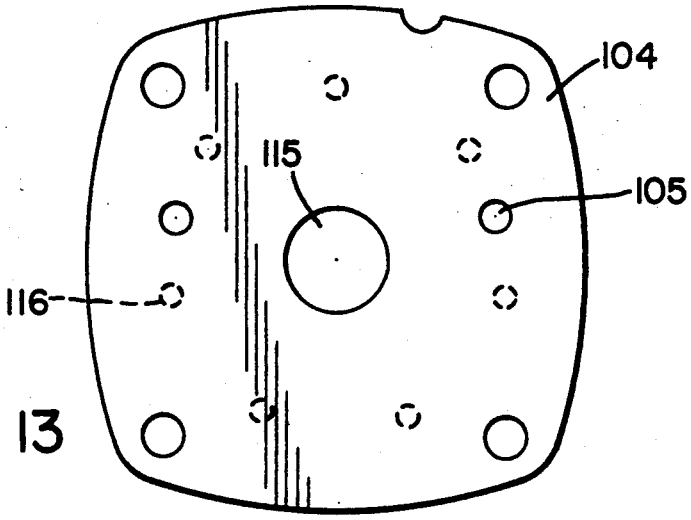
Figure 14:
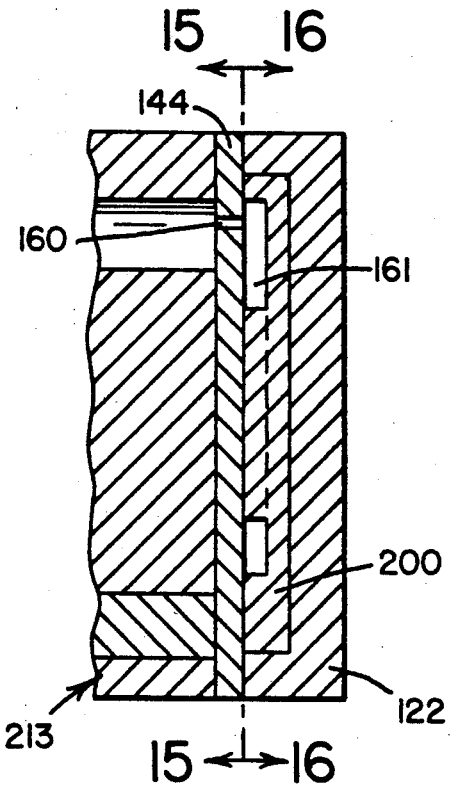
FIGS. 14–17 are selected views of a modified adjustable displacement disengagement mechanism for gerotor devices.
Figure 15:
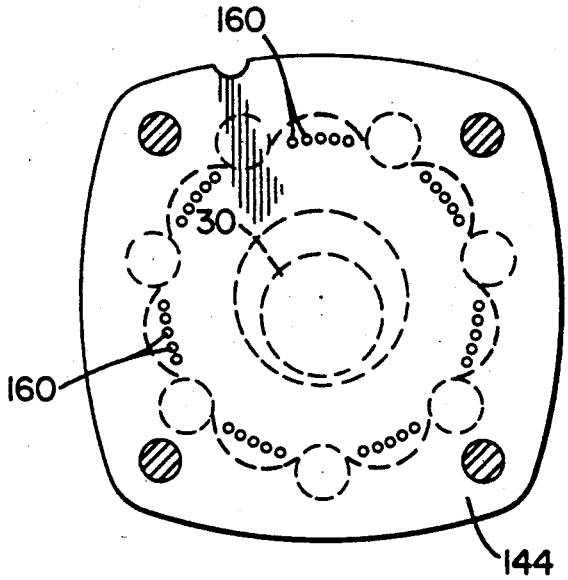
Figure 16:
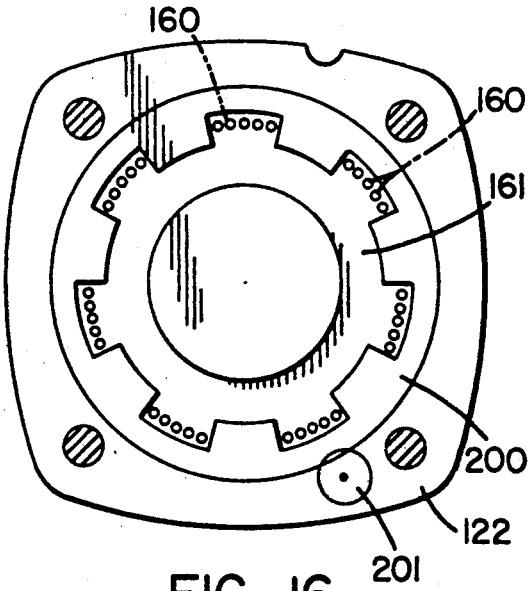
Figure 17:
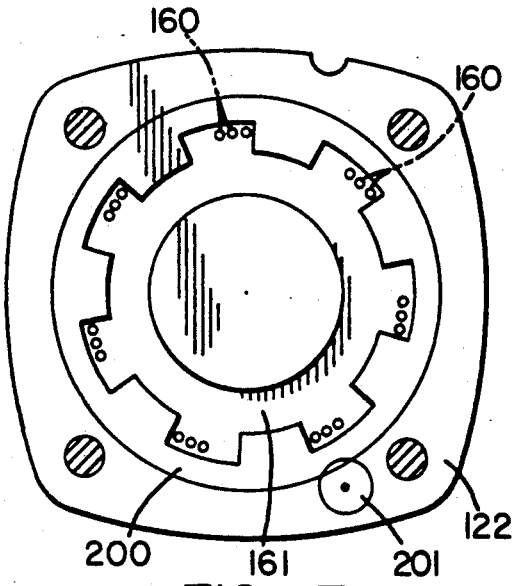

The invention has been described in its preferred form with a certain degree of particularity. It is to be understood that numerous changes in the described embodiment may be had without deviating from the invention as claimed. For example in the embodiment shown a disengagement mechanism was described in a double gerotor device. The disengagement mechanism was described with holes 60 leading directly to the gerotor cells of a single gerotor structure 12. In an obvious modification, there could be multiple disengagement mechanisms in such device 10—indeed FIG. 1 shows such a second mechanism associated with the second gerotor structure 13. This second mechanism can be operated in parallel with the mechanism of structure 13 or independently as desired. The mechanisms could also siphon off the fluid from intermediate passages 111 (by moving the bypass mechanism to adjacent the manifold of the gerotor structure and connecting the chamber 61 to the passages 111 instead of directly to the gerotor cells—for example to passages 111 through holes 116 shown in dotted form in FIG. 13 instead of directly from the gerotor cells as in FIG. 1. (Such a bypass mechanism is shown in dotted lines in plate 21 of FIG. 1.) The disengagement mechanism could also be utilized with a single separately valved gerotor structure (also shown in FIG. 8—basic structure described in Mr. Hollis White's Closed Center Hydraulic Device patent application Ser. No. 080,606 filed Aug. 3, 1987). The invention could also be utilized with vane pumps, multiple piston pumps, and other devices using pressure differentials between enclosed areas. Therefor, although this invention has been described in its preferred form with a certain degree of particularity, it is to be understood that numerous changes may be made without departing from the invention as hereinafter claimed.

What is claimed is:

1. In a device using a pressure differential between expanding and contracting working chambers to rotate a shaft, the working chambers having a fixed plate adjoining such chambers, the improvement of equalization means within the body of the device to equalize the pressure between the working chambers, said equalization means including a fluid bypass chamber and holes extending through the fixed plate adjoining the working chambers directly to said fluid bypass chamber, with flow of fluid through said holes equalizing the pressure between the working chambers, and said equalization means preventing the flow of fluid through said holes in the engaged condition of the device.

2. In a device using a pressure differential between expanding and contracting working chambers to rotate a shaft, the improvement of equalization means within the body of the device to equalize the pressure between the working chambers, and said equalization means having a capacity to selectively bypass part of the pressurized fluid in respect to the working chambers to the unpressurized return to reduce the volume of fluid operating the working chambers.

3. In a device using a pressure differential between expanding and contracting working chambers to rotate a shaft, the device having a fixed body, the improvement of equalization means within the body of the device to equalize the pressure between the working chambers, said equalization means including holes in the fixed body of the device leading from the working chambers directly to a fluid bypass chamber, with flow of fluid through said holes equalizing the pressure between the working chambers, and said equalization means preventing the flow of fluid through said holes in the engaged condition of the device.

4. The device of claim 3 characterized in that said equalization means includes a valve member to close off said holes.

5. The device of claim 4 characterized by the addition of a fluid bypass chamber and in that said valve member is located in said fluid bypass chamber.

6. The device of claim 5 characterized in that said valve member divides said fluid bypass chamber into two sides, one side connected to said holes and the other side connected to a source of high pressure.

7. In a device utilizing a pressure differential between expanding and contracting working chambers to rotate a shaft, the working chambers having a fixed plate adjoining such working chambers, the device having multiple passages leading to the working chambers with a certain flow capacity for the volume of fluid passing into the working chambers therethrough, the improvement of an equalization means within the body of the device, said equalization means including a fluid bypass chamber, means to selectively connect said equalization means to the multiple passages of the device to interconnect such multiple passages, said equalization means having flow capacity capability for allowing the passage of a volume of fluid between such multiple passages greater than the certain flow capacity limit for the multiple passages of the device, said equalization means including holes extending through the fixed plate adjoining the working chambers directly to said fluid bypass chamber, with flow of fluid through said holes equalizing the pressure between the working chambers, and said equalization means preventing the flow of fluid through said holes in the engaged condition of the device.

8. In a device utilizing a pressure differential between expanding and contracting working chambers to rotate a shaft, the device having multiple passages leading to the working chambers with a certain flow capacity for the volume of fluid passing into the working chambers therethrough, the improvement of an equalization means within the body of the device, means to selectively connect said equalization means to the multiple passages of the device to interconnect such multiple passages, said equalization means having flow capacity capability for allowing the passage of a volume of fluid between such multiple passages greater than the certain flow capacity limit of the multiple passages of the device, and said means to selectively connect said equalization means to the multiple passages of the device including the working chambers of the device.

9. In a device utilizing a pressure differential between expanding and contracting working chambers to rotate a shaft, the device having a fixed body, the device having multiple passages leading to the working chambers with a certain flow capacity on the volume of fluid passing into the working chambers therethrough, the improvement of an equalization means within the body of the device, means to selectively connect said equalization means to the multiple passages of the device to interconnect such multiple passages, said equalization means having flow capacity capability of allowing the passage of a volume of fluid between such multiple passages greater than the certain flow capacity limit of the multiple passages of the device, said equalization means including holes in the fixed body of the device leading from the working chambers directly to a fluid bypass chamber, with flow of fluid through said holes equalizing the pressure between the working chambers, and said equalization means preventing the flow of fluid through said holes in the engaged condition of the device.

10. In a device utilizing a pressure differential between expanding and contracting working chambers to rotate a shaft, the device having a body, the device having multiple passages leading to the working chambers with a certain flow capacity on the volume of fluid passing into the working chambers therethrough, the improvement of an equalization means within the body of the device, means to selectively connect said equalization means to the multiple passages of the device to interconnect such multiple passages, said equalization means having flow capacity capability of allowing the passage of a volume of fluid between such multiple passages greater than the certain flow capacity limit of the multiple passages of the device, said equalization means including holes in the body of the device leading from the working chambers to a fluid bypass chamber, and said equalization means including a valve member to close off said holes.

11. The device of claim 10 characterized in that said valve member is located in said fluid bypass chamber.

12. The device of claim 11 characterized in that said valve member divides said fluid bypass chamber into two sides, one side connected to said holes and the other side connected to a source of high pressure.

13. In a device utilizing a pressure differential between working chambers to rotate a shaft, the device having multiple passages leading to the working chambers with a certain limit on the volume of fluid passing into the working chambers therethrough, the improvement of an equalization means within the body of the device, means to selectively connect said equalization means to the multiple passages of the device to interconnect such passages, said equalization means having capability of allowing passage of a volume of fluid between such passages greater than the certain limit of the multiple passages of the device, and said equalization means has a variable capacity to selectively bypass part of the pressurized fluid in respect to the working chambers to the unpressurized return to reduce the volume of fluid operating the working chambers, with flow of fluid through said holes equalizing the pressure between the working chambers, and said equalization means preventing the flow of fluid through said holes in the engaged condition of the device.

14. In a device utilizing a pressure differential between expanding and contracting working chambers to rotate a shaft, the device having multiple passages having a limited volume flow capacity leading to the working chambers, the improvement of a cavity in the body of the device, a piston, said piston being located in said cavity dividing such cavity into two chambers, holes, said holes connecting one chamber of said cavity to the working chambers, said holes and said cavity having a flow capacity of allowing a passage of fluid between the working chambers greater than the limited volume flow capacity of the multiple passages of the device, and means to selectively move said piston in said cavity between open and closed positions with the pressure being equalized between working chambers through said holes and cavity to disengage the shaft rotation in said open position of said piston and the pressure in the working chambers being substantially unaffected in said closed position of said piston.

15. The device of claim 14 characterized by the addition of pressurization means to selectively connect the other chamber of said piston to high pressure and wherein said pressurization means is included in said means to selectively move said piston.

16. The device of claim 14 including means to vary the flow capacity of said one chamber of said cavity to reduce said flow capacity to less than the limited volume flow capacity on the multiple passages of the device.

17. The device of claim 14 including means for movement of said piston to vary said flow capacity of said one chamber of said cavity to reduce said flow capacity to less than the limited volume flow capacity of the multiple passages of the device.

18. In a device utilizing a pressure differential between expanding and contracting working chambers to rotate a shaft, the device having multiple passages having a limited volume flow capacity leading to the working chambers, the improvement of a bypass channel in the body of the device, a valve member, said valve member being located in said bypass channel dividing such channel into two chambers, holes, said holes connecting one chamber of said bypass channel to the working chambers, said holes and said bypass channel being capable of allowing a flow passage of fluid between the working chambers greater than the limited volume flow capacity of the multiple passages of the device, and valving means to connect the other chamber of said bypass channel to a source of pressure to selectively move said valve member in said bypass channel between open and closed positions with the pressure being equalized between working chambers through said holes and bypass channel to disengage the shaft rotation in said open position of said valve member and the pressure in the working chambers being substantially unaffected in said closed position of said valve member.

19. In a device utilizing a pressure differential between expanding and contracting working chambers to rotate a shaft, the device having multiple passages having a limited volume flow capacity leading to the working chambers, the improvement of a cavity in the body of the device, a disk piston, said disk piston being located in said cavity dividing such cavity into two chambers, holes, said holes connecting one chamber of said cavity to the working chambers, said holes and said cavity being capable of allowing a flow passage of fluid between the working chambers greater than the limited volume flow capacity of the multiple passages of the device, and valving means to connect the other chamber of said cavity to a source of pressure to selectively move said disk piston in said cavity between open and closed positions with the pressure being equalized between working chambers through said holes and cavity to disengage the shaft rotation in said open position of said disk piston and the pressure in the working chambers being substantially unaffected in said closed position of said disk piston.

20. The device of claim 19 characterized by the addition of means for movement of said disk piston to vary the flow capacity of said one chamber of said cavity so as to reduce said flow capacity to less than the limited volume flow capacity of the multiple passages of the device.

21. The device of claim 20 characterized in that said disk piston has rotary movement.

22. The device of claim 21 characterized in that said disk piston has longitudinal movement.

23. The device of claim 14 including means to vary the flow capacity of said holes to reduce said flow capacity to less than the limited volume flow capacity on the multiple passages of the device.

24. The device of claim 14 including means for movement of said piston to vary said flow capacity of said holes to reduce said flow capacity to less than the limited volume flow capacity of the multiple passages of the device.

25. The device of claim 19 characterized by the addition of means for movement of said disk piston to vary the flow capacity of said holes so as to reduce said flow capacity to less than the limited volume flow capacity of the multiple passages of the device.

* * * * *